US008332065B2

(12) United States Patent
Kurakata

(10) Patent No.: US 8,332,065 B2
(45) Date of Patent: Dec. 11, 2012

(54) SHEET PROCESSING APPARATUS, CONTROL METHOD OF SHEET PROCESSING APPARATUS, AND STORAGE MEDIUM

(75) Inventor: Tsuyoshi Kurakata, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 451 days.

(21) Appl. No.: 12/637,454

(22) Filed: Dec. 14, 2009

(65) Prior Publication Data

US 2010/0161112 A1 Jun. 24, 2010

(30) Foreign Application Priority Data

Dec. 18, 2008 (JP) ..... 2008-322987

(51) Int. Cl.
*B65H 33/04* (2006.01)
*B65H 39/00* (2006.01)
*G06F 7/00* (2006.01)

(52) U.S. Cl. ..... 700/217; 270/58.19; 270/58.17; 270/58.18; 270/58.09; 270/58.12; 270/58.21; 270/58.22

(58) Field of Classification Search ..... None
See application file for complete search history.

(56) References Cited

U.S. PATENT DOCUMENTS

| | | | | |
|---|---|---|---|---|
| 6,991,225 | B2 * | 1/2006 | Miyake et al. | 270/58.09 |
| 2008/0054558 | A1 | 3/2008 | Obuchi et al. | |
| 2009/0001650 | A1 * | 1/2009 | Ishikawa et al. | 270/58.19 |

FOREIGN PATENT DOCUMENTS

| | | | |
|---|---|---|---|
| CN | 101139055 | A | 3/2008 |
| JP | 2008-087965 | A | 4/2008 |
| JP | 2008-162753 | A | 7/2008 |

* cited by examiner

*Primary Examiner* — Gene Crawford
*Assistant Examiner* — Yolanda Jones
(74) *Attorney, Agent, or Firm* — Canon U.S.A., Inc. IP Division

(57) ABSTRACT

A method includes causing a stacking device having a first stacking unit and a second stacking unit to stack sheets of a small size on the first stacking unit or the second stacking unit and to stack sheets of a large size over the first stacking unit and the second stacking unit, and controlling the stacking of sheets by restricting stacking of the sheets of the large size on the sheet of the small size when the sheets of the small size are stacked on at least one of the first stacking unit and the second stacking unit.

25 Claims, 12 Drawing Sheets

FIG. 11A

| | PRESENCE OR ABSENCE OF SHEET | STACKED SHEET SIZE |
|---|---|---|
| STACK TRAY A | ABSENT | – |
| STACK TRAY B | ABSENT | – |

FIG. 11B

| | PRESENCE OR ABSENCE OF SHEET | SHEET-STACKING STATUS |
|---|---|---|
| STACK TRAY A | PRESENT | A4 |
| STACK TRAY B | ABSENT | – |

FIG. 11C

| | PRESENCE OR ABSENCE OF SHEET | STACKED SHEET SIZE |
|---|---|---|
| STACK TRAY A | PRESENT | A4 |
| STACK TRAY B | PRESENT | B5 |

FIG. 11D

| | PRESENCE OR ABSENCE OF SHEET | STACKED SHEET SIZE |
|---|---|---|
| STACK TRAY A | PRESENT | A3 |
| STACK TRAY B | PRESENT | A3 |

FIG. 12

| | |
|---|---|
| SMALL SIZE | A4, B5 |
| LARGE SIZE | A3, B4 |

FIG. 14A

| | PRESENCE OR ABSENCE OF SHEET | STACKED SHEET SIZE | NUMBER OF SHEETS (SHEET) |
|---|---|---|---|
| STACK TRAY A | ABSENT | – | 0 |
| STACK TRAY B | ABSENT | – | 0 |

FIG. 14B

| | PRESENCE OR ABSENCE OF SHEET | SHEET-STACKING STATUS | NUMBER OF SHEETS (SHEET) |
|---|---|---|---|
| STACK TRAY A | PRESENT | A4 | 1000 |
| STACK TRAY B | ABSENT | – | 0 |

FIG. 14C

| | PRESENCE OR ABSENCE OF SHEET | STACKED SHEET SIZE | NUMBER OF SHEETS (SHEET) |
|---|---|---|---|
| STACK TRAY A | PRESENT | A4 | 1000 |
| STACK TRAY B | PRESENT | B5 | 1500 |

FIG. 14D

| | PRESENCE OR ABSENCE OF SHEET | STACKED SHEET SIZE | NUMBER OF SHEETS (SHEET) |
|---|---|---|---|
| STACK TRAY A | PRESENT | A3 | 500 |
| STACK TRAY B | PRESENT | A3 | 500 |

SHEET PROCESSING APPARATUS, CONTROL METHOD OF SHEET PROCESSING APPARATUS, AND STORAGE MEDIUM

BACKGROUND OF THE INVENTION

1. Field of the Invention

The present invention relates to a sheet processing apparatus, a control method for controlling such a sheet processing apparatus, and a storage medium.

2. Description of the Related Art

Some of the sheet processing apparatuses, which have been known in the art, are provided with a plurality of stacking units designed like stacking trays in a stacker device that stacks sheets therein, where sheets are stacked on each of the stacking units.

Among these sheet processing apparatuses, there is one in which sheets of a small size (hereinafter, also referred to as small sheets) are stacked on each of plural stacking units in a stacker device and large sheets are stacked over the plural stacking units (see, for example, Japanese Patent Laid-Open No. 2008-87965).

However, when a small sheet is stacked on the first stacking unit or the second stacking unit included in the plural stacking units and a large sheet is stacked over both the first stacking unit and the second stacking unit, the following disadvantage may occur. That is, depending on the way of stacking sheets, the stacked sheets will become unstable.

For instance, when large sheets are stacked over plural stacking units where small sheets have been already stacked on one of plural stacking units but no sheet on the others, the staked large sheets may be leaned and become unstable.

In addition, even if small sheets are stacked on each of the plural stacking units, the stacked large sheets may be leaned and become unstable when a difference between the heights of the sheets on the respective stacking units occurs.

SUMMARY OF THE INVENTION

An aspect of the present invention is an apparatus that includes: a stacking control unit configured to cause a stacking device having a first stacking unit and a second stacking unit to stack sheets of a small size on the first stacking unit or the second stacking unit and to stack sheets of a large size over the first stacking unit and the second stacking unit; and a control unit configured to cause the stacking control unit to restrict stacking of the sheets of the large size on the sheets of the small size when the sheets of the small size are stacked on at least one of the first stacking unit and the second stacking unit.

Further features of the present invention will become apparent from the following description of exemplary embodiments with reference to the attached drawings.

BRIEF DESCRIPTION OF THE DRAWINGS

FIG. 11 is a diagram illustrating a stacking state management table according to the embodiment of the present invention;

FIG. 12 is a diagram illustrating a stacking state management table according to the embodiment of the present invention;

FIG. 14 is a diagram illustrating a stacking state management table according to the embodiment of the present invention.

DESCRIPTION OF THE EMBODIMENTS

Figure 1:
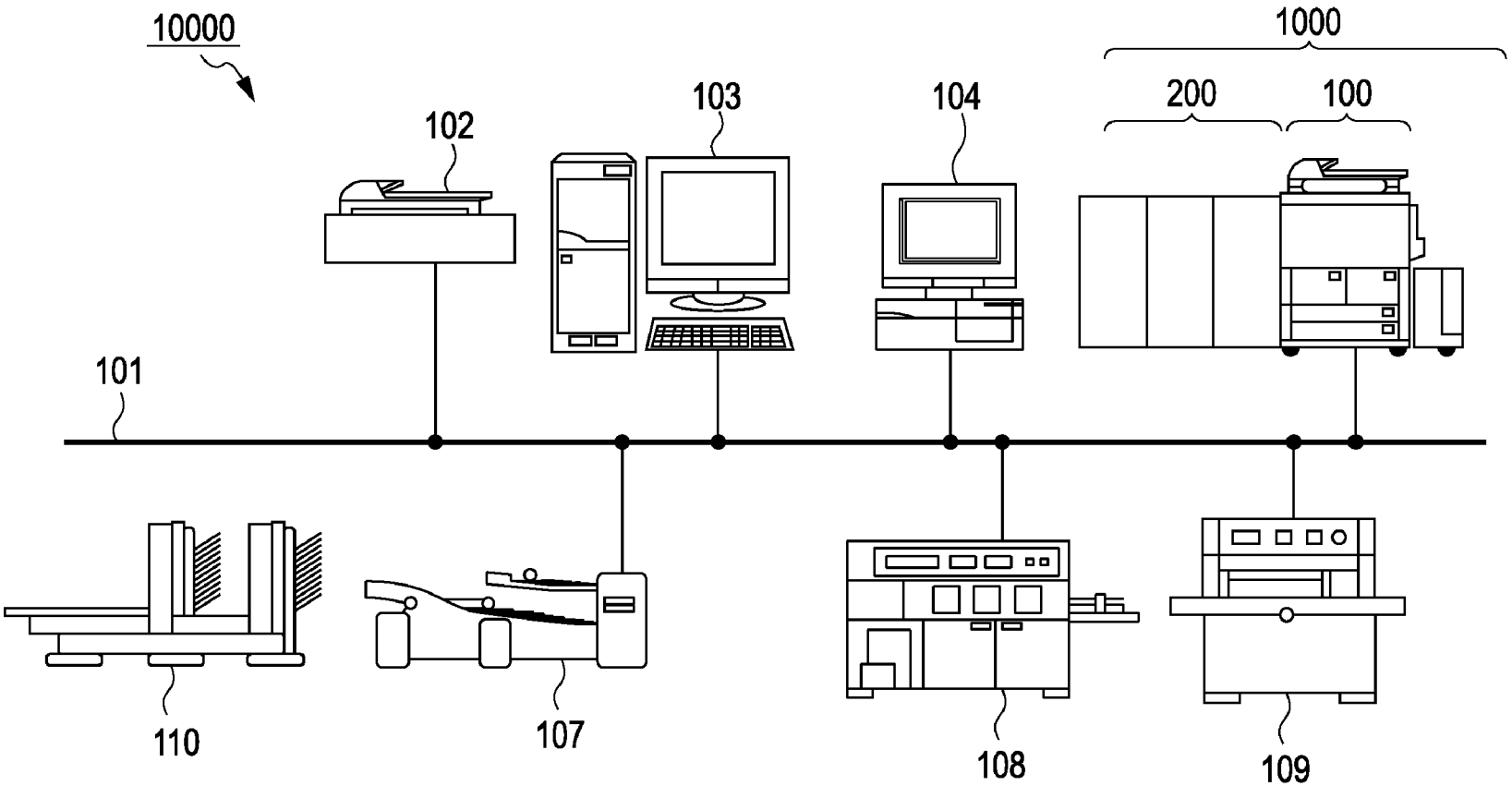
FIG. 1 is a diagram illustrating the configuration of a POD system 10000 according to an embodiment of the present invention.

FIG. 1 illustrates the configuration of a print-on-demand (POD) system 10000 including a printing system as an example of a sheet processing apparatus of an embodiment of the present invention.

The POD system 10000 includes a printing system 1000, a server computer 103, a client computer (PC) 104. The POD system 10000 also includes a scanner 102, a paper folding machine 107, a case binding machine 108, a trimmer 109, and a saddle stitch binding machine 110. The constitutional members of the POD system 10000 other than the saddle stitch binding machine 110 are connected to one another through network 101.

The printing system 1000 includes a printer 100 and a sheet processing apparatus 200.

The printer 100 receives print data from the PC 104 and then performs printing on a sheet according to the received print data, followed by allowing the sheet processing apparatus 200 to process the printed sheet if required. Hereinafter, the printer 100 will be described using an image scan apparatus, a multifunction peripheral (MFP) having a plurality of functions, such as a copying function and a PC printing function. Alternatively, however, it may be a single-function printer only having a PC printing function.

The paper folding machine 107, the case binding machine 108, the trimmer 109, and the saddle stitch binding machine 110 are defined as apparatuses for performing post processing of the printed sheet, similar to the sheet processing apparatus 200 installed in the printing system 1000. The user takes out the sheet printed by the printer 100 from the paper ejecting section of the printing system 1000 and sets the taken-out sheet in the sheet processing apparatus to perform the post processing. For example, the user allows the paper folding machine 107 to execute folding of the printed sheet. In addition, the user allows the case binding machine 108 to execute case binding of the printed sheet. Furthermore, the user allows the trimmer 109 to execute trimming of the printed sheet. Still furthermore, the user allows the saddle stitch binding machine 110 to execute saddle-stitch binding of the printed sheet.

Next, with reference to FIG. 2, the configuration of the printing system 1000 will be described.

Figure 2:
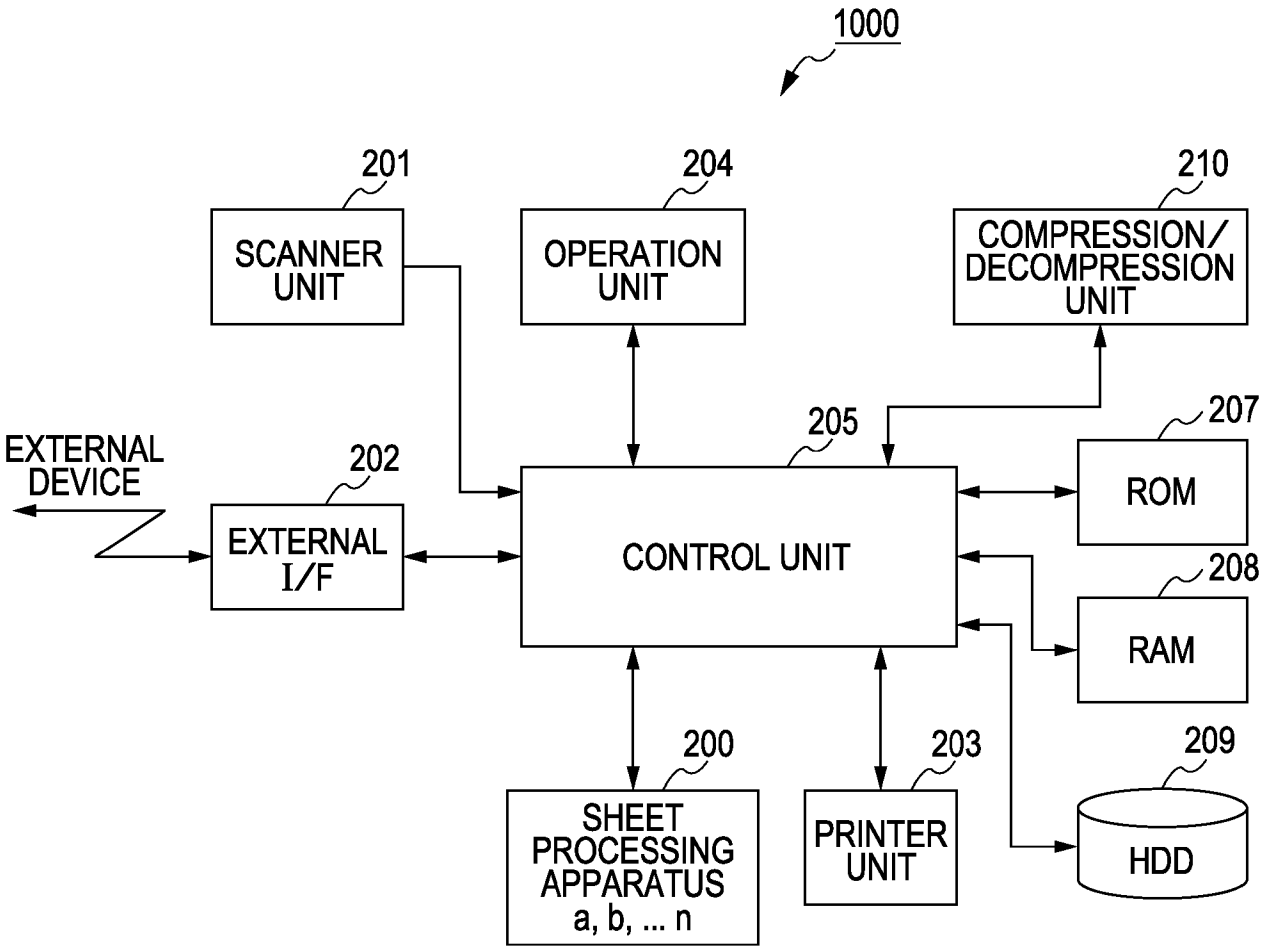
FIG. 2 is a block diagram illustrating the configuration of a printing system 1000 according to the embodiment of the present invention.

FIG. 2 is a block diagram that illustrates the configuration of the printing system 1000. The printing system 1000 includes a scanner unit 201, an external interface (I/F) unit 202, a printer unit 203, an operation unit 204, a control unit 205, a read-only memory (ROM) 207, a random access memory (RAM) 208, and a hard disk drive (HDD) 209. These constitutional members of the printing system 1000 are connected to one another through an internal bus of the printing system 1000.

The control unit 205 reads out a program stored in the ROM 207 to centrally control the printing system 1000.

The scanner unit 201 reads an original and then generates the image data of the read original. The generated image data is transmitted to the control unit 205.

The external I/F unit 202 controls the transmission/reception of data between the control unit 205 and external networks 101. For example, the external I/F unit 202 transmits image data transmitted from the external device, such as the PC 104, to the control unit 205. In addition the external I/F unit 202 transmits the data received from the control unit 205 to the external device such as the PC 104 through the network 101.

The printer unit 203 prints the image data received from the control unit 205 on a sheet according to print settings (information about print layout, the number of sets, and so on) received from the control unit 205.

The operation unit 204 includes a main display, a touch panel, hard keys, and so on. The operation unit 204 displays an operation screen on the main display and receives instructions from the user through a touch panel on the main display. In addition, the operation unit 204 may receive instructions from the user through the hard keys. Subsequently, the operation unit 204 transmits the received instructions to the control unit 205.

The ROM 207 stores a program to be executed by the control unit 205.

The RAM 208 functions as a work memory of the control unit 205 and temporarily stores the program and the image data read out from the ROM 207.

The HDD 209 is a nonvolatile storage medium. The HDD 209 stores the data of jobs to be executed in the order of execution.

For example, when executing a copy job, the control unit 205 stores the image data read from the scanner unit 201 as a job in the HDD 209 while associating the job with the print settings received from the user through the operation unit 204. Then, the stored job is executed. The control unit 205 executes the job stored in the HDD 209 to allow the printer unit 203 to print the image data according to the print settings stored in association with the image data stored in the HDD 209.

Furthermore, when executing the print job, the control unit 205 associates the image data received through the external I/F unit 202 with the print settings to store the image data as a job in the HDD 209, followed by executing the stored job. The control unit 205 executes the job stored in the HDD 209 to print the image data stored in the HDD 209 on a sheet on the basis of the print settings stored in association with the image data.

The HDD 209 can store a plurality of jobs, and the control unit 205 can execute these stored jobs in the order of reception. Here, the user may change the execution sequence of the jobs. Also, the control section 205 may change the execution sequence if a predetermined condition is satisfied.

The compression/decompression unit 210 performs compression and decompression processing on the image data stored in the RAM 208 or the HDD 209 based on various compression formats, such as Joint Bi-level Image Experts Group (JBIG) or Joint Photographic Experts Group (JPEG).

The sheet processing apparatus 200 is connected to the printer 100 and performs various kinds of sheet processing, such as sheet loading, case binding, and saddle-stitch binding, on the sheet printed by the printer 100.

Figure 3:
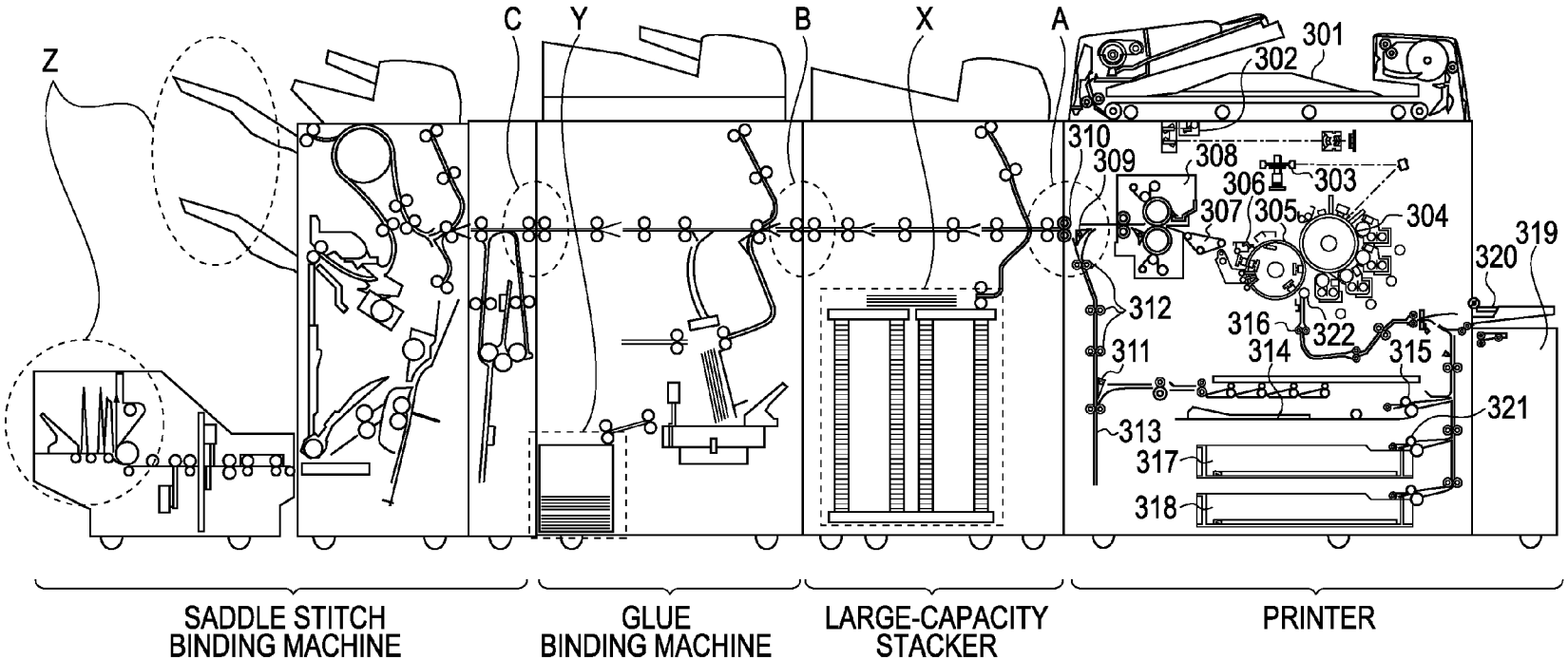
FIG. 3 is a cross-sectional diagram illustrating the configuration of the printing system 1000 according to the embodiment of the present invention.

Referring now to FIG. 3, the configuration of the printing system 1000 will be described.

FIG. 3 is a cross-sectional view of the printing system 1000.

In the present embodiment, the printer 100 is a single-drum (1D) type color multifunction device. However, the present invention is not limited to this. That is, a monochromatic multifunction device or a four-drum (4D) type MFP may be used as the printer 100. Here, the composite machine is also called a multi-function peripheral (MFP).

An auto document feeder (ADF) 301 separates an original document set on a document tray page by page from the first page. Then, the ADF 301 feeds the original document onto a document positioning glass to scan the document with a reading unit 302. The reading unit 302 reads an image on the document that has been conveyed onto the document positioning glass and converts the read document image into image data with an image sensor, such as a charge-coupled device (CCD). A ray, such as a laser beam, which has been modulated according to the image data, is made incident on a rotating polygonal mirror 303. The laser beam reflected from a rotating multifaced mirror (e.g., a rotating polygonal mirror) and then irradiated on the surface of a photosensitive drum 304 through a reflection mirror. The latent image formed on the surface of the photosensitive drum 304 with the ray is then developed with toner.

Furthermore, the printer 100 conveys a sheet fed from any one of paper feed cassettes 317 through 320, each of which is an example of a paper feed unit, to a registration roller 316. The printer 100 further attaches the sheet to a transfer drum 305 to transfer a toner image on a photosensitive drum 304 onto the sheet attached to the transfer drum 305.

By serially performing a series of image forming processing on toners of colors of yellow (Y), magenta (M), cyan (C), and black (K), a full color image is formed. After performing four-image forming processing, a sheet on the transfer drum 305, onto which a full color image has been formed, is then separated from the transfer drum 305 by a separation claw 306. Then, the separated sheet is fed to a fixing device 308 by a pre-fixing conveyance unit 307. The fixing device 308 includes rollers and a belt in combination with one another. Furthermore, the fixing device 308 includes therein a heat source such as a halogen heater. The fixing device 308 applies heat and pressure to the toner on the sheet having the transferred toner image. Thus, the toner on the sheet having the toner image can be fused and fixed. A sheet discharge flapper 309 can swing around an axis to regulate the direction of conveying a sheet. When the sheet discharge flapper 309 swings clockwise in the figure, the sheet is conveyed in a straight direction. Subsequently, a paper discharge roller 310 feeds the sheet to a large-capacity stacker 200*a*.

On the other hand, in performing a two-sided print job, the sheet discharge flapper 309 swings counterclockwise in the figure to change the path of the sheet to a downward direction. As a result, the sheet is fed into a two-sided conveyance unit. The two-sided conveyance unit includes a reversal flapper 311, a reversal roller 312, a reversal guide 313, and a two-sided tray 314. The reversal flapper 311 swings around a rocking shaft around an axis and regulates the direction of conveying the sheet. When processing a double-side print job, the control unit 201 controls the reversal flapper 311 to swing counterclockwise in the figure. Thus, the sheet having the image-printed first surface can be fed to the reversal guide 313 through the conveying roller 312. Then, the control unit 201 temporarily stops the reversal roller 324 in the state where the posterior edge of the sheet is pinched by a reversal roller 324. Subsequently, the control unit 201 allows the reversal flapper 311 to swing clockwise in the figure to rotate the reverse roller 324 in the reverse direction. As described above, the control unit 201 performs control so that the sheet is switched back to be conveyed. The control unit 201 performs control to guide the sheet to the two-sided tray 314 in the state where the leading edge and trailing edge of the sheet have been changed in position. The two-sided tray 314 temporarily holds the sheet. After that, the sheet can be conveyed again to the registration roller 316 by a paper feed roller 315. At this time, the sheet is fed with a surface thereof opposite to the first surface used in the transfer processing facing the photosensitive drum 304. Then, the control unit 201 performs control to form an image on the second surface of the sheet as in the processing described above. Thus, images are formed on both sides of the sheet. Then, the sheet is subjected to fixing processing by the fixing device 308. After that, the sheet is conveyed to the subsequent apparatuses by the paper discharge roller 310.

The sheet of the job set to stack the sheet on the large-capacity stacker among the subsequent apparatuses is conveyed to the large-capacity stacker so that it can be stacked thereon. In addition, the sheet of the job set to bind a book by the glue binding machine is conveyed to the glue binding machine. Furthermore, the sheet of the job set to perform saddle stitch binding is conveyed to the saddle stitch binding machine.

Subsequently, the sheets are subjecting to sheet processing in the sheet processing apparatuses and then ejected to the paper ejecting sections thereof, respectively.

Figure 4:
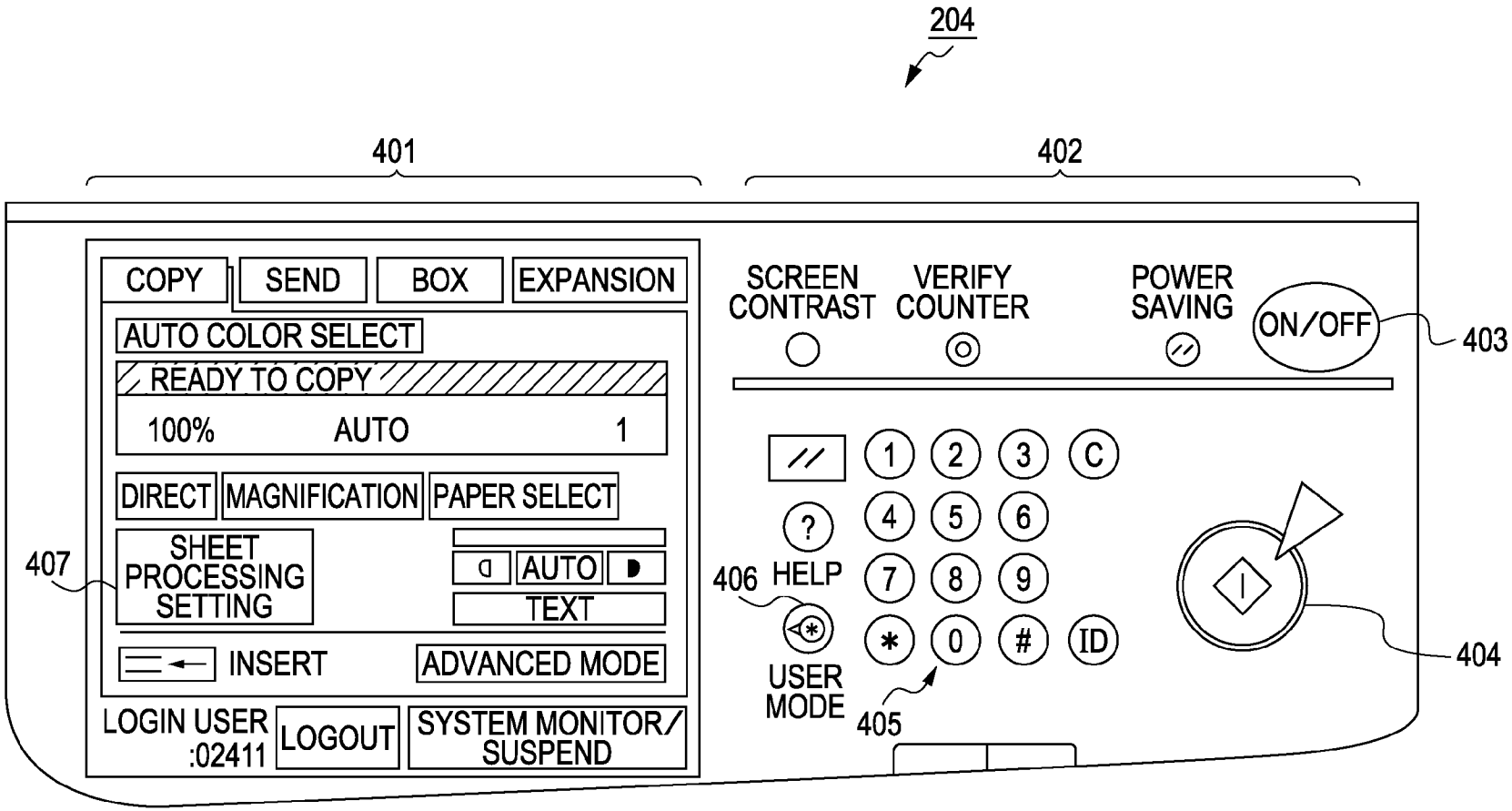
FIG. 4 is a schematic diagram illustrating an operation unit 204 according to the embodiment of the present invention.

FIG. 4 is a diagram illustrating the configuration of the operation unit 204.

The operation unit 204 includes a touch panel section 401 having soft keys and a key input section 402 having hard keys.

The touch panel section 401 includes a liquid crystal display (LCD) and a touch panel attached on the LCD. The touch panel section 401 receives instructions from the user. In addition, the touch panel section 401 notifies the user by displaying various messages thereon.

When a copy tab on the touch panel section 401 is pressed by the user, an operating screen for the copy function is displayed on the touch panel section 401. When the transmission tab 602 is pressed by the user, an operating screen with a data sending (Send) function, such as fax or E-mail, is displayed on the touch panel section 401. When a box tab is pressed by the user, an operating screen for the box function is displayed on the touch panel section 401. The term "box function" means a function that the image data read by the scanner unit 201 is previously stored in the HDD 209, the print data stored in the HDD 209 is then selected with desired timing, and the selected print data is printed by the printer unit 203.

A power switch 403 is a button for switching the mode of the printing system 1000 between a standby mode (normal operation state) and a sleep mode (state of stopping a program in an interrupt-standby state in anticipation of network printing, facsimile, or the like, and suppressing power consumption).

A start key 404 is a key for enabling the user to instruct the printing apparatus 100 to start the types of jobs instructed by the user, such as copying operations or sending operations.

A numeric keypad 405 is a set of keys for enabling the user to set the number of copies, input of a password, and so on.

A user mode key 406 is a key for enabling the user to perform various types of settings of the printing system 1000.

A sheet processing set key 407 is a key for enabling the user to set sheet processing performed by the sheet processing apparatus 200. If the sheet processing set key 407 is pressed, then the control unit 205 displays a screen shown in FIG. 5 on the touch panel unit 401.

Figure 5:
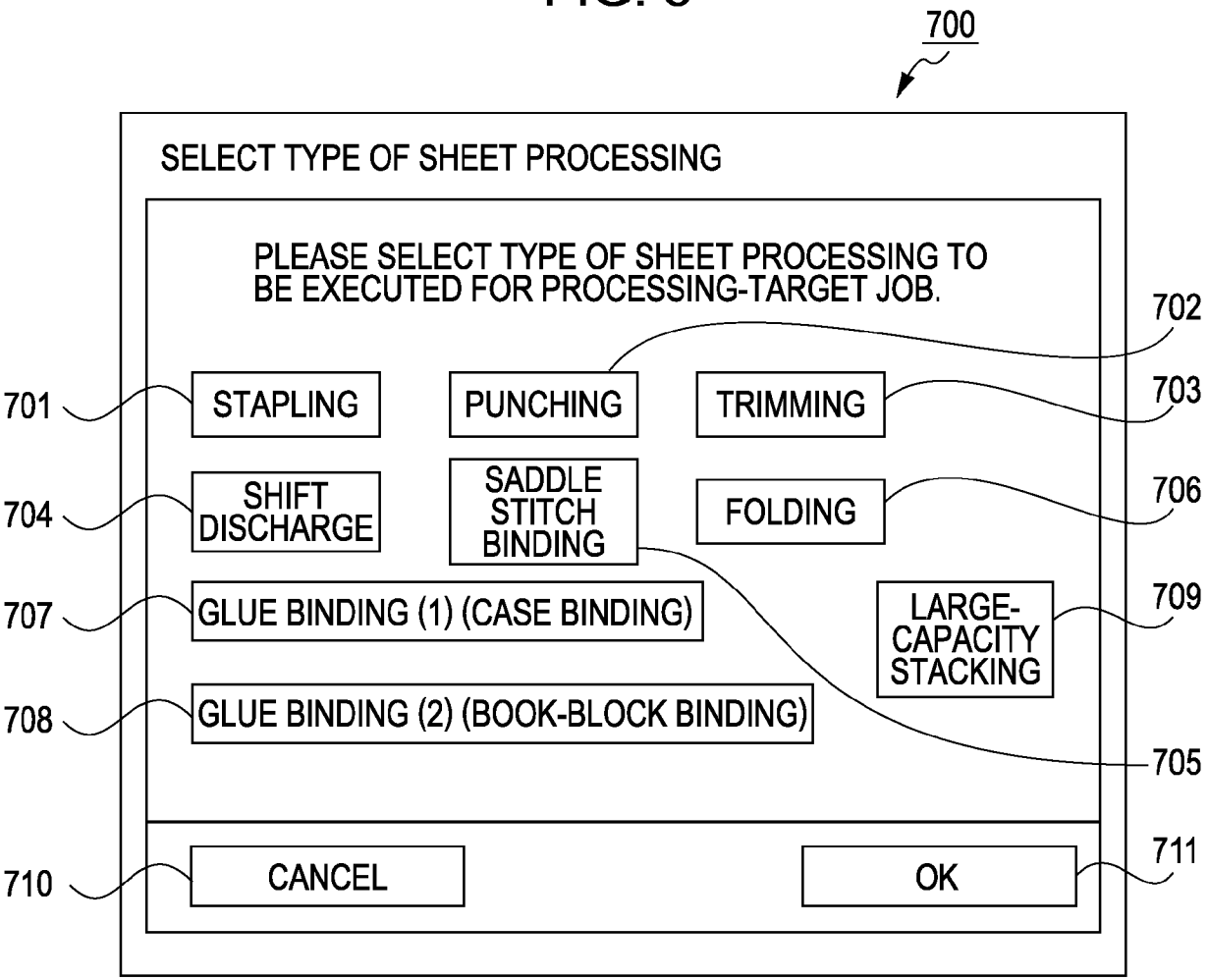
FIG. 5 is a diagram illustrating a screen for receiving settings of sheet processing according to the embodiment of the present invention.

The screen shown in FIG. 5 displays keys for receiving settings of seat processing executable by the printing system 1000. The types of the executable seat processing may be changed depending on the configuration of the printing system 1000.

The keys represented in FIG. 5 include keys for performing various kinds of processing of:

(1) stapling (key 701);
(2) punching (key 702);
(3) trimming (key 703);
(4) shift paper ejecting (key 704);
(5) saddle-stitch binding (key 705);
(6) folding (key 706);
(7) case binding (key 707);
(8) glue binding (key 708); and
(9) large-capacity stacking (key 709).

Among these kinds of processing (1) to (9), the control unit 205 enables the printer 100 to perform the sheet processing selected through the screen shown in FIG. 5 on a sheet printed by the printer 100.

For example, if the OK key 711 is pressed while the key 705 is being selected in the copy function and then the start key 404 is pressed, the control unit 205 allows the scanner unit 201 to read the original. Then, the control unit 205 prints the image data of the read original depending on the print settings received through the operation unit 204. Subsequently the control unit 205 conveys the printed sheet to the saddle stitch binding machine shown in FIG. 3 and then allows the saddle stitching binding machine to perform saddle-stitching binding.

Furthermore, in the copy function, if the OK key 711 is pressed while the key 709 is being selected, then the control unit 205 allows the scanner unit 201 to read an original when the start key 404 is pressed. Subsequently, the control unit 205 allows the printer unit 203 to print the image data of the read original according to the print settings received from the user through the operation unit 204. After that, the control unit 205 feeds the printed sheet to a large-capacity stacker 600 shown in FIG. 3 and then allows the large-capacity stacker 600 to execute large-capacity stacking.

Figure 6:
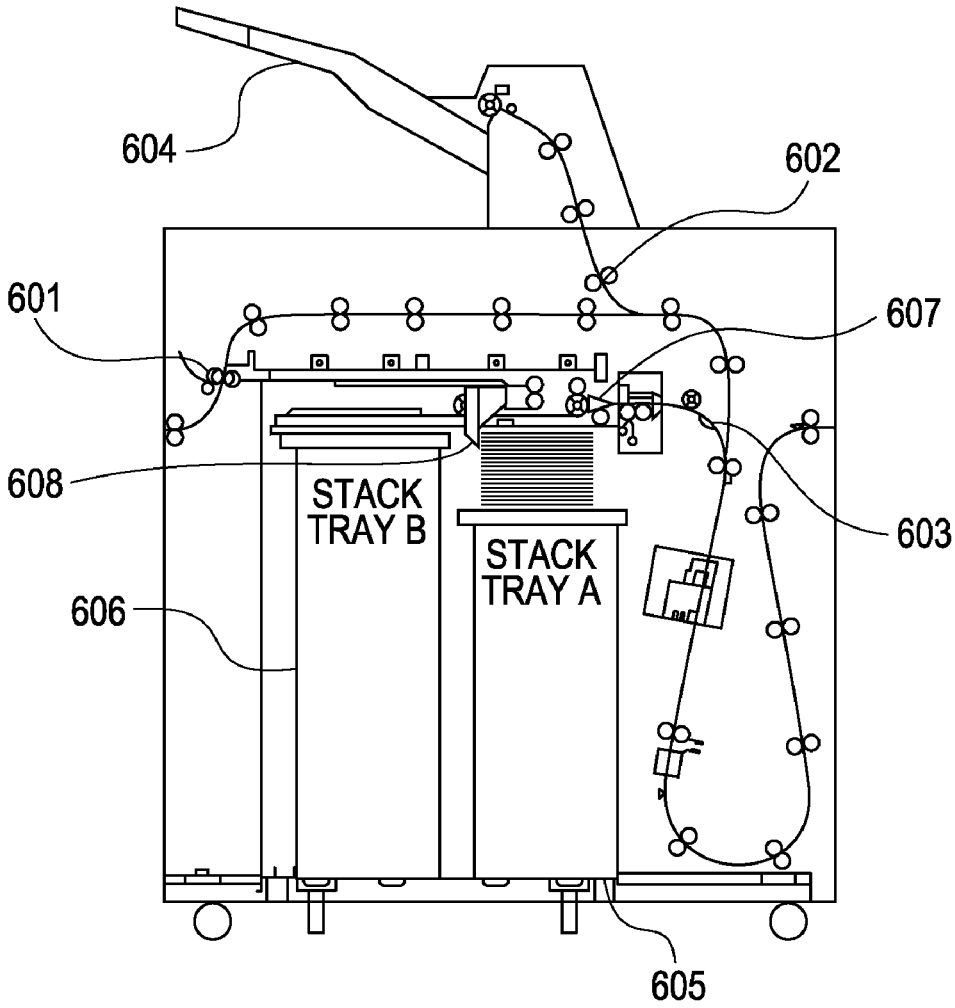
FIG. 6 is a cross-sectional diagram illustrating the configuration of a large-capacity stacker according to the embodiment of the present invention.

FIG. 6 is a diagram that illustrates an exemplary configuration of the large-capacity stacker. Here, the shape of a sheet conveying path is not limited to one shown in FIG. 6. Alternatively, the large-capacity stacker may be shaped like one shown in FIG. 3.

The large-capacity stacker includes a straight path 601, an escape path 602, and a stack path 603.

The straight path 601 is a sheet-conveying path for conveying sheets received from a previous apparatus (the printer 100 in this embodiment) to a later apparatus (the case binding machine in this embodiment). The straight path 601 within the large-capacity stacker is a sheet conveyance path for sending the sheets of a job not requiring sheet stacking to the later apparatus.

The escape path 602 is provided for conveying a sheet to an escape tray 604.

The stack pass 603 is a sheet-conveying path for conveying printed sheets to load them on a stacker tray A or B by executing the job specified to load the sheets on the large-capacity stacker.

Figure 7:
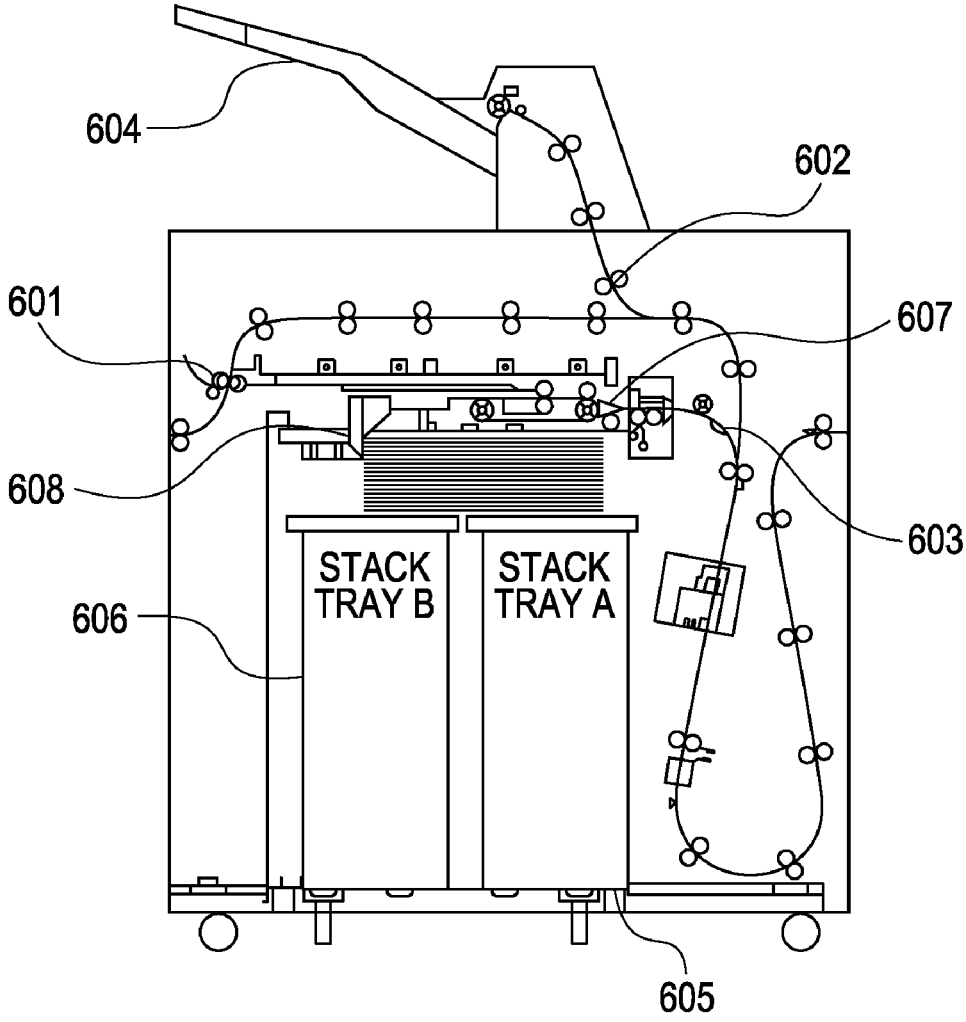
FIG. 7 is a cross-sectional diagram illustrating the configuration of a large-capacity stacker according to the embodiment of the present invention.
Figure 13:
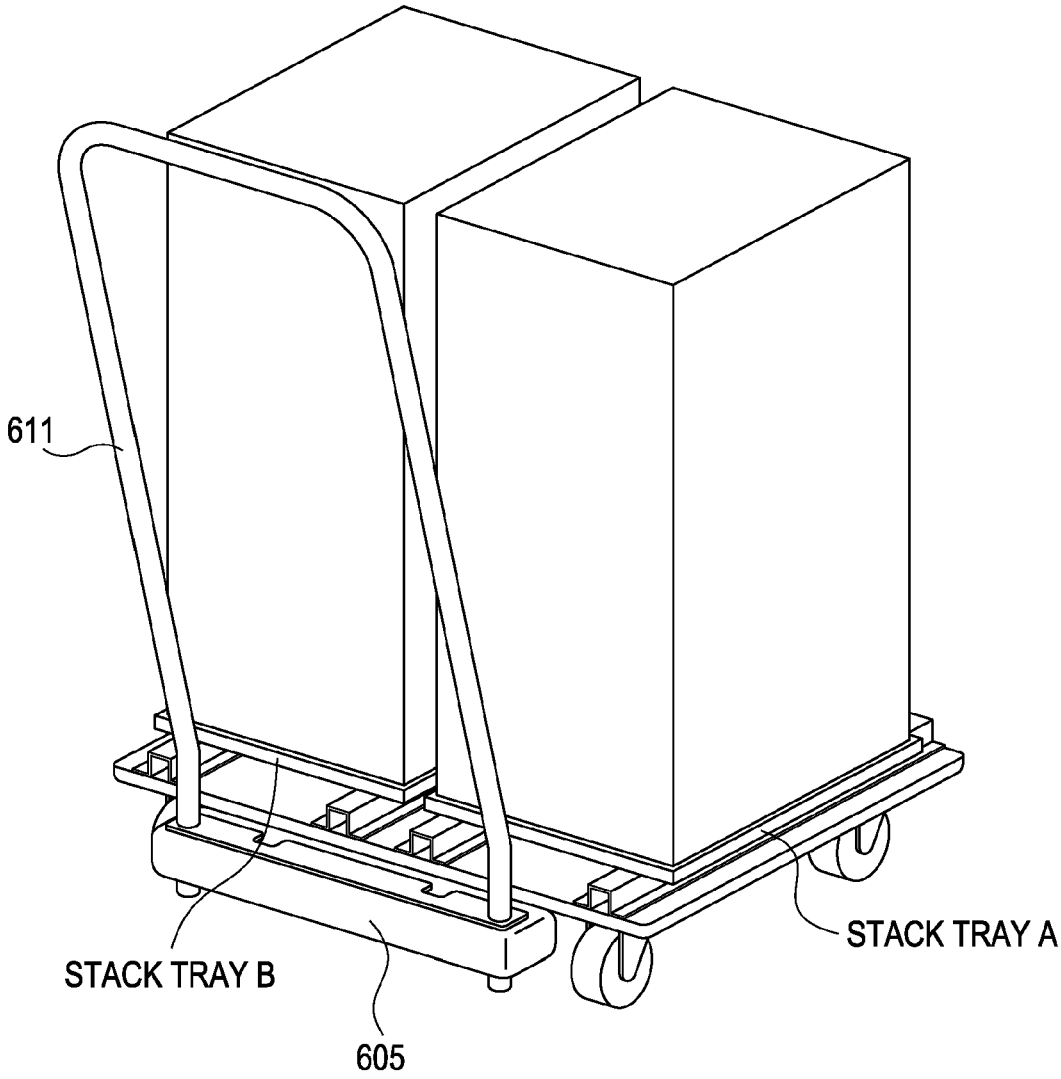
FIG. 13 is a diagram illustrating the configuration of a large-capacity stacker according to the embodiment of the present invention.

The large-capacity stacker includes two stacker trays (loading trays) A and B on which sheets can be loaded. The stacker trays A and B are attached on a cart 605 by an expandable stay 606, respectively. The cart 605 is provided with a handle 611 as shown in FIG. 13 to enable the user to carry the sheets loaded on each of the stackers A and B from one sheet processing apparatus to another sheet processing apparatus. When receiving an instruction of opening the front door (not shown) of the large-capacity stacker, each stacker tray descends to a position shown in FIG. 13 to allow the user to easily carry the stacker tray with the cart 605. In addition, each of the stacker trays A and B moves to an upper position shown in FIG. 6 or FIG. 7 to easily load the sheets ejected from the stack path 607 onto the stacker tray in response to the attachment of the cart on the large-capacity stacker. As shown in FIG. 6 or FIG. 7, each of the stacker trays A and B moves upward so that the uppermost surface of the sheets loaded on the stacker tray can reach the same level as that of the stacker path.

Then, the direction of the sheet ejected from the stack path 603 is changed by the flapper 607 so that it can be loaded on either the stacker tray A or the stacker tray B. When the sheet is loaded on the stacker tray B, the sheet is guided to the stacker tray A along a downward sheet-conveying path by the flapper 607 and then ejected to the stacker tray A. In addition, when loading the sheet on the stacker tray B, the flapper 607 allows the sheet to be conveyed by the upward conveying path. Thus, the sheet can be ejected to the stacker tray B. When loading the sheet on the stacker tray A, the control unit 205 displaces an abutting plate 608 to the position of the stacker tray A to load the sheet on the stacker tray A while loaded sheets can be conformably stacked one on top of the other on the stacker tray A. On the other hand, when loading the sheet on the stacker tray B, the control unit 205 displaces the abutting plate 608 to the position of the stacker tray B to load the sheet on the stacker tray B while loaded sheets can be conformably stacked one on top of the other on the stacker tray B.

In addition, as shown in FIG. 7, the sheet may be ejected so that it can extend over two stacker trays. In this case, the sheet can be guided along the downward conveying path and then ejected. The control unit 205 enables the abutting plate 608 to be moved depending on the size of the sheet to load the sheet on the stacker trays A and B while loaded sheets can be conformably stacked one on top of the other on the stacker trays A and B. For example, if the width of the sheet to be ejected in the conveying direction is larger than the width of one stacker tray, the control unit 205 controls the ejection of the stacker so that the sheet extending over two stacker trays can be ejected. When ejecting the sheet extending over two stacker trays, the forward end of the sheet may be introduced on the stacker tray B by a pinching member mounted on the abutting plate 608 to prevent the sheet to be introduced into the stacker tray A and the stacker tray B. Here, a sheet having a width in the conveying direction which is larger than the width of one stacker tray is defined as a small sheet. In addition, a sheet having a width in the conveying direction which is equal to or smaller than the width of one stacker tray is defined as a small sheet.

Figure 8:
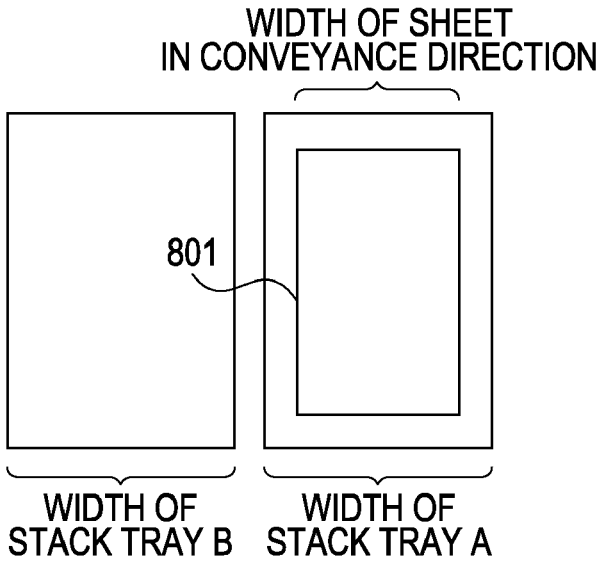
FIG. 8 is a diagram illustrating the configuration of a stacker tray of the large-capacity stacker according to the embodiment of the present invention.
Figure 9:
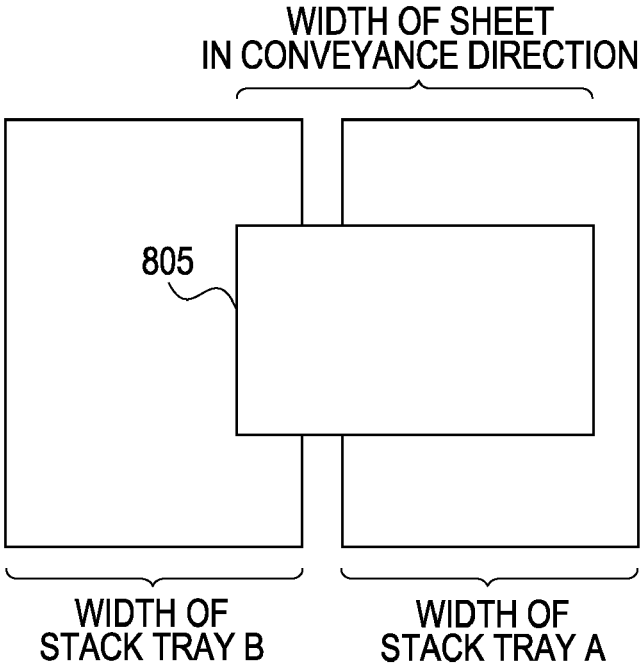
FIG. 9 is a diagram illustrating the configuration of a stacker tray of the large-capacity stacker according to the embodiment of the present invention.
Figure 10:
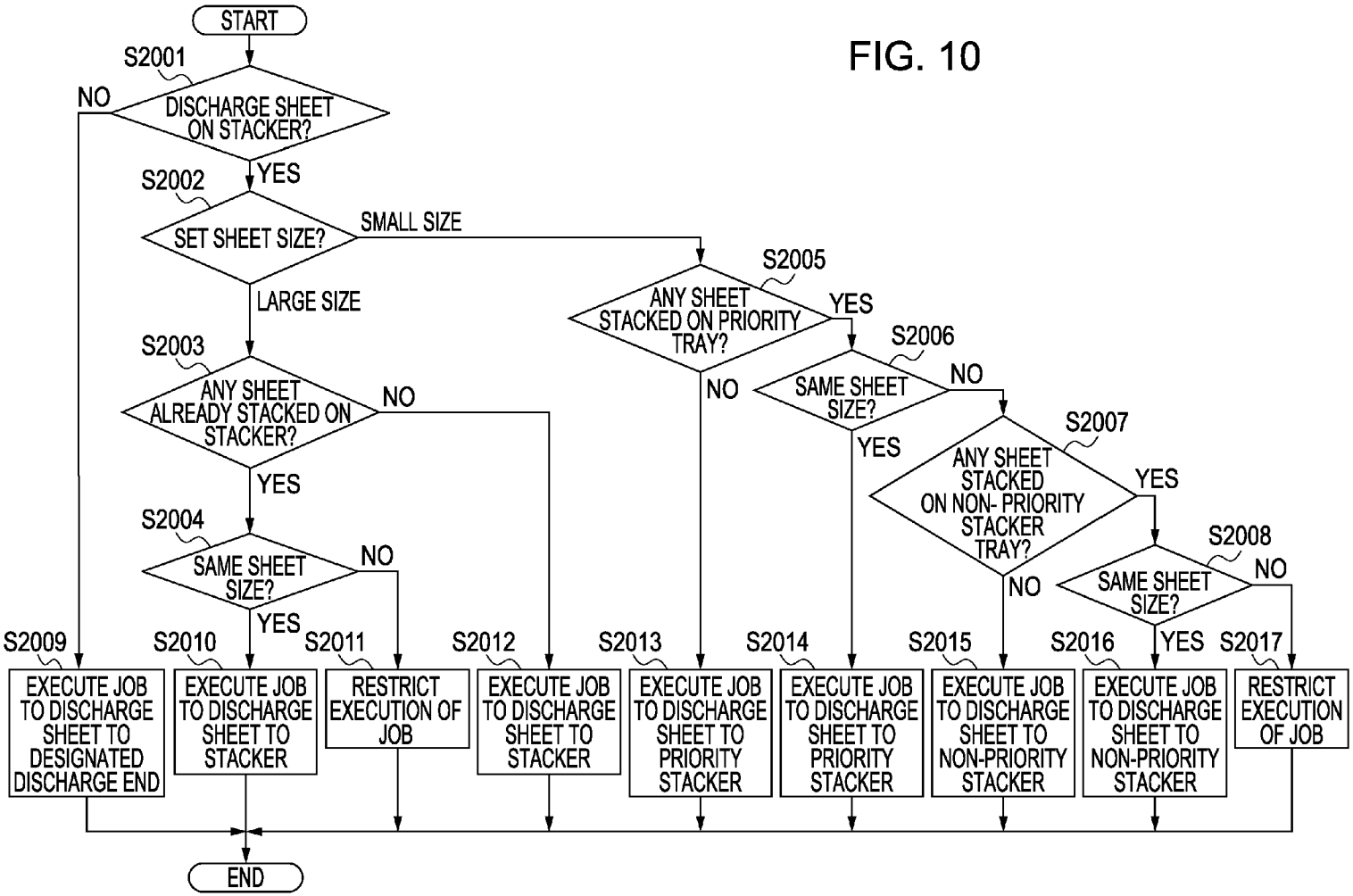
FIG. 10 is a flow chart illustrating sheet-stacking processing according to the embodiment of the present invention.

Each of FIGS. 8 to 10 is a top view of the stacker trays.

In FIG. 8, a small sheet 801 is placed on the stacker tray A. The width of the sheet 801 in the conveying direction is smaller than the width of the stacker tray A.

In FIG. 9, a small sheet 805 is placed on both the stacker tray A and the stacker tray B. In other words, when loading the small sheet, the conveyance of the sheet 805 is controlled so that the sheet 805 can ejected over two stacker trays A and B as shown in FIG. 9.

Since the printing system 1000 of the present embodiment is configured as described above, various kinds of the sheet processing thereof can be controlled as described below.

Referring now to FIG. 10, sheet-loading processing under control of the control unit 205. The processing of the respective steps illustrated in a flow chart of FIG. 10 is carried out by allowing the control unit 205 to read out a program stored in the ROM 207 and execute the program.

When receiving an instruction of executing a job from the operation unit 204 in the copy function, the control unit 205 enables the RAM 208 to store the received job information. The received job information may include, for example, settings (e.g., the type of sheet processing and the information about sheets to be used) received from the user through the operation unit 204 shown in FIG. 4 or FIG. 5. The information about sheets to be used is set to "auto" as a default and automatically determined depending on the size of an original after reading the original by the scanner unit 201. Alternatively, the size of the sheet may be specified to one among various sizes, such as A4 and B5, by using a paper selection button, "PAPER SELECTION," represented on the operation unit 204 in FIG. 4. When receiving the instruction for executing the job, the control unit 205 performs the processing represented by the flow chart in FIG. 10 based on the information about the job stored in the RAM 208 and the information about the sheets loaded on the stacker trays. The information about sheets loaded on the stacker trays is stored as stacking state management tables as shown in FIGS. 11A to 11D in the RAM 208, respectively.

In step S2001, according to information about a job, the control unit 205 determines whether a sheet ejected by executing the job should be ejected to the stacker tray of the large-capacity stacker. If the job is one set to carry out the processing of loading a large number of sheets through the operation unit 204, then the ejection end of the job is the stacker tray of the large-capacity stacker. Therefore, if the job is one set to carry out the processing of loading a large number of sheets, then the control unit 205 concludes that the sheets of the job should be ejected to the stacker tray of the large-capacity stacker and then advances the processing to step S2002. On the other hand, if the control unit 205 concludes that the received job is not set to carry out the processing of loading a large number of sheets, then the control unit 205 advances the processing to step S2009.

In step S2009, the control unit 205 performs control so that the sheet can be ejected to the ejection end specified by the job. For example, if the job is set to one to perform case binding, the control unit 205 allows the sheet to be conveyed to the glue binding machine. Then, the sheet is subjected to the case binding processing, followed by being ejected to the paper ejecting section of the glue binding machine. Furthermore, if the job is one set to carry out saddle-stitch binding, the control unit 205 allows the sheet to be conveyed to the saddle stitch binding machine. Then, the sheet is subjected to the saddle-stitch binding, followed by being ejected to the paper ejecting section of the saddle stitch binding machine. Consequently, the processing is ended.

If the processing is advance to step S2002, then the control unit 205 determines whether the size of the sheet used for the job is large or small. The control unit 205 enables the RAM 208 to retain a table as shown in FIG. 12 and determines whether the size of the sheet of the received job is large or small. If the sheet of the received job is A4 or B5, then it is concluded that the sheet is a small-sized one. If the sheet of the received job is A3 or B3, then the control unit 205 concludes that the sheet is a large-sized one. The sheet sizes shown in FIG. 12 are only provided for illustrative purposes. Therefore, a large or small size may be defined with respect to any of other sheet sizes, such as a letter size and a legal size. In addition, even in the case of the same A4 size, if the sheets are placed in the paper feed unit so that the sheets can be conveyed in the longitudinal direction of the sheet, or if the A4 sheet is horizontally placed in the paper feed unit, the horizontally-oriented A4 sheet may be defined as a large-sized one. If the control unit 205 concludes that the sheet of the job has a large size, then the processing is advanced to step S2003. On the other hand, if the control unit 205 concludes that the sheet of the job has a small size, then the proceeding is advanced to step S2005.

In step S2003, the control unit 205 determines whether there is any sheet already stacked on the large-capacity stacker. To determine whether there is any sheet already stacked on the large-capacity stacker, for example, the control unit 205 may use any of stacking state management tables such as those illustrated in FIGS. 11A to 11D. The stacking state management tables are stored in the RAM 208 or HDD 209.

FIG. 11A illustrates the state in which there is still no sheet stacked on each of the stacker trays A and B. In this regard, if the control unit 205 executes job 1 and ejects an A4 sheet to the stacker tray, then the control unit 205 changes the state of presence or absence of the sheet on the stacker tray A from "absence" to "presence" and also changes the size of the stacked sheet from "-" to "A4". The stacking state management table at this time is illustrated in FIG. 11B.

If the control unit 205 subsequently executes job 2 and ejects a B5 sheet to the stacker tray B, then the control unit 205 changes the state of presence or absence of the sheet on the stacker tray B from "absence" to "presence" and also changes the size of the stacked sheet from "-" to "B5". The stacking state management table at this time is illustrated in FIG. 11C.

The large-capacity stacker includes sensors that detect the presence or absence of sheet stacked on the respective stacker trays A and B. If the sensor detects the absence of the sheet, then the large-capacity stacker returns the state of the stacking state management table to one shown in FIG. 11A. For example, if sheets which have been stacked on the stacker tray are completely taken out of the stacker tray, then there is no sheet stacked on the large-capacity stacker. In this case, the control unit 205 resets the stacking state management table to the state shown in FIG. 11A based on the information from the sensor.

Furthermore, FIG. 11D illustrates a stacking state management table updated by the control unit 205 when a small sheet is ejected over the stacker trays A and B.

The control unit 205 uses such a stacking state management table to determine whether there is any sheet already stacked on at least one of the stacker trays A and B of the large-capacity stacker.

If the control unit 205 concludes that any sheet is stacked on at least one of the stacker trays A and B, then the control unit 205 advances the processing to step S2004. On the other hand, if the control unit 205 concludes that any sheet is not stacked on each of the stacker trays A and B, then the control unit 205 advances the processing to step S2012.

If the processing is advanced to step S2012, the control unit 205 performs control so that a small sheet ejected by executing the job can be stacked over both the stacker trays A and B. In this case, as shown in FIG. 9, both the stacker trays A and B simultaneously receive the same stacked sheet.

On the other hand, if the processing is advanced to step S2004, then the control unit 205 determines whether the stacked sheet has the same size as that of the sheet ejected by executing the job. If the control unit 205 concludes that the stacked sheet has the same size as that of the sheet ejected by executing the job, then the processing is advanced to step S2010. In addition, if the control unit 205 concludes that the stacked sheet has a size different from that of the sheet ejected by executing the job, then the processing is advanced to step S2011.

In step S2010, the control unit 205 allows a small sheet to be stacked on the small sheet which has been already stacked. This is because the size of the sheet is the same as the size of the sheet to be ejected from now while the small sheet has been already stacked. Thus, even if the sheet is ejected, the remaining stacked sheet can be prevented from being unstable.

In step S2011, the control unit 205 saves the job to restrict the execution of the job. This is because the size of a sheet to be ejected is different from the size of a small sheet already stacked on the large-capacity stacker. Thus, as a result of ejecting the sheet, the remaining sheet may become unstable. Here, the phrase "saves the job" means that the job is saved in a save area of the HDD 209. Here, the control unit 205 displays a message on the operation unit 204, where the message is "Please remove sheets from large-capacity stacker". Thus, the job which has been saved may be executed when the user has removed the sheets from the large-capacity stacker.

Next, the case in which the processing is advanced from step S2002 to step S2005 will be described.

In step S2005, the control unit 205 determines whether any sheet is stacked on a priority tray based on the stacking state management table. Here, the term "priority tray" used herein means a stacker tray previously set up as a priority tray. In this embodiment, the stacker tray A is set up as a priority tray. The conveyance path of a sheet to be ejected to the stacker tray A is shorter than that of a sheet to be ejected to the stacker tray B, so that the former can be output faster than the latter. Therefore, the time consumed for sheet ejection can be shortened by setting up the stacker tray A as a dominant tray and ejecting the sheet from the stacker tray A than the stacker tray B.

In step S2005, if the control unit 205 concludes that there is no sheet stacked on the stacker tray A, then the processing is advanced to step S2013. On the other hand, it the control unit 205 concludes that there is a sheet stacked on the stacker tray A, then the processing is advanced to step S2006.

In step S2013, the control unit 205 completes the processing after stacking the sheet on the stacker tray A which has been set up as a priority tray.

If the processing is advanced to step S2006, then the control unit 205 determines whether the sheet stacked on the stacker tray A has the same size as that of the sheet to be ejected from now. If the control unit 205 concludes that the sheet stacked on the stacker tray A has the same size as that of the sheet to be ejected from now, the processing is advanced to step S2014. On the other hand, If the control unit 205 concludes that the size of the sheet stacked on the stacker tray A is different from that of the sheet to be ejected from now, the processing is advanced to step S2007.

In S2014, the control unit 205 allows a sheet to be stacked on the stacker tray A provided as a priority tray. It is based on that, if there is a sheet already stacked on the stacker tray A and the size of such a sheet is the same as that of a sheet to be ejected from now, the remaining stacked sheet may not become unstable as a result of ejecting the sheet.

If the processing is advanced to step S2015, then the control unit 205 determines whether there is any sheet already stacked on the stacker tray B which is not the priority tray.

If the control unit 205 concludes that there is no sheet already stacked on the stacker tray B which is not the priority tray, then the processing is advanced to step S2015. On the other hand, it the control unit 205 concludes that there is a sheet already stacked on the stacker tray B which is not the priority tray, then the processing is advanced to step S2008.

In step S2015, the control unit 205 completes the processing after ejecting the sheet to the stacker tray B.

If the processing is advanced to step S2008, then the control unit 205 determines whether the sheet stacked on the stacker tray B has the same size as that of a sheet to be ejected from now. If the control unit 205 concludes that they have the same size, then the processing is advanced to step S2016. On the other hand, if the control unit 205 concludes that they have different sizes, then the processing is advanced to step S2017.

In step S2016, the control unit 205 completes the processing after ejecting the sheet to the stacker tray B.

In step S2017, the control unit 205 saves the job to restrict the execution of the job because of no stacker tray on which sheets can be stacked. Here, the control unit 205 displays a message on the operation unit 204, where the message is "Please remove sheets from large-capacity stacker". Thus, the execution of the job is resumed when the user has removed the sheets from the large-capacity stacker. In this way, when stacking a small sheet on the stacker tray, the control unit 205 performs control so that sheets having different sizes can be prevented from mixing up.

By controlling the sheet stacking processing as described above, the control unit 205 can stack sheets on top of the other while preventing the stacked sheets from becoming unstable on the basis of the stacking state of the sheets stacked on the stacker tray. Specifically, the stability of the stacked sheets can be maintained when the printing system 1000 can execute a process of stacking a sheet on each of a plurality of stacking units and a process of stacking a sheet over a plurality of stacking units.

Furthermore, in the above embodiment, descriptions have been made for preventing the stacked sheets from becoming unstable by prohibiting the stacking of a large sheet over the stacker trays A and B when the small sheets have been already stacked the stacker tray A or B. However, when the heights of the stacked sheets on the respective stacker trays are substantially equal to each other, the stacked sheets can be prevented from becoming unstable even if a large sheet is further stacked thereon. Therefore, the control unit 205 may manage the number of sheets stacked on each of the stacker trays A and B using stacking state tables represented in FIGS. 14A to 14C. If a difference between the number of sheets stacked on the stacker tray A and the number of sheets stacked on the stacker tray B is smaller than a predetermined number, the control unit 205 may permit the stacking of a large sheet. If the difference between the numbers of sheets stacked on the stacker trays A and B, then the control unit 205 prohibits the stacking of a large sheet. The predetermined number may be one sheet or may be ten sheets. If the predetermined value is one sheet, then the stacking of large sheets can be permitted only when the number of sheets stacked on the stacker tray A and the number of sheets stacked on the stacker tray B are equal. In addition, the predetermined number may be determined by the user through the operation unit 204.

Alternatively, the height of the stacked sheets may be managed as information for the stacking state table in stead of the information about the number of sheets, where the height of the stacked sheets can be obtained by accumulating the number of sheets and the thickness of a sheet together. In this case, if a difference between the height of the sheets stacked on the stacker tray A and the height of the sheets stacked on the stacker tray B is smaller than the predetermined number, then the control unit 205 permits the stacking of a small sheet. On the other hand, if the difference between the height of the sheets stacked on the stacker tray A and the height of the sheets stacked on the stacker tray B is equal to or higher than the predetermined number, then the control unit 205 prohibits the stacking of a large sheet. The sheet stacking processing can be performed in consideration of a difference in thickness of sheet due to a difference in type of sheet by determining whether the stacking of a large sheet is permitted based on the information about the height of sheets. Alternatively, as described above, the user may determine whether the stacking of a large sheet on a small sheet according to the requirements, such as the number of sheets and the height of sheets. For example, if a large sheet is stacked on a small sheet stacked on any of the stacked trays, then it becomes difficult to take out the small sheet. In such a case, the user may set up to prohibit the stacking of a large sheet on a small sheet to prevent the small sheet from difficulty in being taken out.

Furthermore, in the above embodiment, descriptions have been made for the example of preventing a large sheet from being stacked on a small sheet while the small sheet has been stacked over the stacker trays A and B. However, the present invention is not limited to such an example. Alternatively, the stacking of a large sheet on a small sheet may be permitted. Alternatively, furthermore, the user may set up to determine whether a large sheet may be allowed to be stacked on a small sheet.

Furthermore, the above embodiment has been descried in the case of executing the job using a copy function through the operation unit 204. The same kinds of processing may be applied to the case where a job using a box function that prints image data stored in the HDD 209 is executed. When executing the job using the box function, the user selects image data stored in the HDD 209 through the operation unit 204 and performs print settings to instruct printing of an image. Upon receiving the instruction of printing, the control unit 205 executes the processing of FIG. 10 depending on the kind of sheet processing and the sheet settings included in the print settings received through the operation unit 204. In addition, the present embodiment is not limited to the copy function and the box function. Alternatively, the present embodiment is applicable when a job received from an external personal computer (PC) 104. In that case, the user may employ the printer driver of the external PC 104 to determine the kind of sheet processing and the settings of a sheet for printing and then transmits the job to the printing system 1000. If the control unit 205 of the printing system 1000 receives a job from the external PC 104, then it executes the processing of FIG. 10 depending on the kind of sheet processing and the print sheet settings of the job.

In the above embodiment, furthermore, the descriptions have been made for the example in which the control unit 205 evacuates the job and restricts the execution of the job when the processing is advanced to step S2011 or step S2017, then the control unit 205. However, the present embodiment is not limited to such an example. For example, the control unit 205 may determine whether there is a job for ejecting a sheet having the same size as that of a sheet already stacked among jobs following the job to be executed. If the control unit 205 concludes that there is a job. Then, the job executes such a job in priority to the evacuated job. For example, it is assumed that A4 sheets are stacked on the stacker tray A and B5 sheets are stacked on the stacker tray B. Then, the processing is ended without executing the sheet when a job of ejecting an A5 sheet in the above embodiment. In this case, instead of the evacuated job, among jobs following such a job, the control unit 205 may perform control so that a job for executing an A4 sheet or a B5 sheet can be executed. By performing the job control in this way, printing efficiency can be improved.

In the above embodiment, furthermore, the descriptions have been made for the example in which the stacker tray A is defined as a priority tray. Alternatively, the priority tray may be designed to be changed by the user. Therefore, a sheet can be predominantly ejected to the stacker tray to which the user wishes to place priority.

The processing illustrated in the figure of the present embodiment may be executed by a host computer, such as a PC 104, by a program installed from the outside. In this case, furthermore, the PC 104 may display the respective operation screens and may receive the user's operations through a mouse, a keyboard, or the like installed in the PC 104.

In addition, the stacker tray A as described above may be referred to as a first stacking unit or a second stacking unit, and also the stacker tray B may be also referred to as a first stacking unit or a second stacking unit. The control unit 205 performs control of stacking sheets on these stacking units.

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Patent Application No. 2008-322987, filed on Dec. 18, 2008, which is hereby incorporated by reference herein in its entirety.

What is claimed is:

1. An apparatus comprising:

a stacking control unit configured to cause a stacking device having a first stacking unit and a second stacking unit to stack sheets of a small size on the first stacking unit or the second stacking unit and to stack sheets of a large size on both of the first stacking unit and the second stacking unit; and a control unit configured to restrict the stacking device from stacking the sheets of the large size on the sheets of the small size when the sheets of the small size are stacked on at least one of the first stacking unit and the second stacking unit.

2. The apparatus according to claim 1, wherein the control unit permits stacking of the sheets of the large size on the sheets of the small size by the stacking control unit when a difference between a height of sheets stacked on the first stacking unit and a height of sheets stacked on the second stacking unit is smaller than a predetermined value.

3. The apparatus according to claim 2, wherein the control unit permits stacking of the sheets of the small size when the sheets of the small size are stacked on at least one of the first and second stacking units.

4. The apparatus according to claim 1, wherein the control unit permits the stacking device to stack additional sheets of the large size on the sheet of the large size when the sheets of the large size are stacked on both of the first stacking unit and the second stacking unit.

5. The apparatus according to claim 1, wherein the small size includes plural different sizes, and the control unit permits the stacking device to perform control so that the sheets of the plural different sizes are stacked on the first stacking unit or the second stacking unit while being prevented from mixing together.

6. The apparatus according to claim 1, further comprising:

a notifying unit configured to allow the control unit to notify a user to remove stacked sheets when stacking of the sheets of the large size on the sheets of the small size is restricted.

7. The apparatus according to claim 1, wherein the sheets of the large size are sheets to be ejected by execution of a job.

8. The apparatus according to claim 7 further comprises a job control unit configured to allow the control unit to execute, among jobs subsequent to the job for ejecting the sheets of the large size, a job for ejecting the sheets of the small size in advance of executing the job for ejecting the sheets of the large size when stacking of the sheets of the large size ejected by execution of the job on the sheets of the small size is restricted.

9. A method comprising:

stacking sheets of a small size on a first stacking unit of a stacking device or the second stacking unit of the stacking device;

stacking sheets of a large size on both of the first stacking unit and the second stacking unit; and controlling the stacking of sheets by restricting stacking of the sheets of the large size on the sheet of the small size when the sheets of the small size are stacked on at least one of the first stacking unit and the second stacking unit.

10. The method according to claim 9, wherein stacking of the sheets of the large size on the sheets of the small size by the stacking control unit is permitted when a difference between a height of sheets stacked on the first stacking unit and a height of sheets stacked on the second stacking unit is smaller than a predetermined value.

11. The method according to claim 10, wherein stacking of the sheets the small size is permitted when the sheets of the small size are stacked on at least one of the first stacking unit and the stacking unit.

12. The method according to claim 9, wherein stacking of additional sheets of the large size on the sheets of the large sheet is permitted when the sheets of the large size are stacked on both of the first stacking unit and the second stacking unit.

13. The method according to claim 9, wherein the small size includes plural different sizes, and the sheets of the plural different sizes are stacked on the first stacking unit or the second stacking unit while being prevented from mixing together.

14. The method according to claim 9 further comprising:

notifying a user of need for removal of stacked sheets when stacking of the sheet of the large size on the sheets of the small size is restricted.

15. The method according to claim 9, wherein the sheets of the large size are sheets to be ejected by execution of a job.

16. The method according to claim 15 further comprises executing, among jobs subsequent to the job for ejecting the sheets of the large size, a job for ejecting the sheets of the small size in advance of executing the job for ejecting the sheets of the large size when stacking of the sheets of the large size ejected by execution of the job on the sheets of the small size is restricted.

17. A computer readable storage medium for storing a computer program for controlling an apparatus, comprising:

a code to control a stacking device having a first stacking unit and a second stacking unit to stack sheets of a small size on the first stacking unit or the second stacking unit and to stack sheets of a large size on both the first stacking unit and the second stacking unit; and a code to control the stacking to restrict stacking of the sheets of the large size on the sheets of the small size when the sheets of the small size are stacked on at least one of the first stacking unit and the second stacking unit.

18. The computer readable storage medium according to claim 17, wherein stacking of the sheets of the large size on the sheets of the small size is permitted when a difference between a height of sheets stacked on the first stacking unit and a height of sheets stacked on the second stacking unit is smaller than a predetermined value.

19. The computer readable storage medium according to claim 17, wherein stacking of the sheets of the small size is permitted when if the sheets of the small size are stacked on at least one of the first stacking unit and the second stacking unit.

20. The computer readable storage medium according to claim 17, wherein stacking of additional sheets of the large size on the sheets of the large sheet is permitted when the sheets of the large size are stacked on both of the first stacking unit and the second stacking unit.

21. An apparatus comprising:

a stacking control unit configured to cause a stacking device having a first stacking unit and a second stacking unit to stack a first sheet on the first stacking unit or the second stacking unit and to stack a second sheet on both of the first stacking unit and the second stacking unit; and a determining unit configured to determine whether a first sheet is stacked on at least one of the first stacking unit and the second stacking unit, wherein the stacking control unit is configured to restrict the stacking device from stacking the second sheet when it is determined by the determining unit that the first sheet is stacked on one of the first stacking unit and the second stacking unit and even if there is not a sheet on another stacking unit.

22. The apparatus according to claim 21, wherein the stacking control unit permits the stacking device to stack an additional first sheet when the first sheet is stacked on at least one of the first and second stacking units.

23. The apparatus according to claim 21, wherein the stacking control unit permits the stacking device to stack an additional second sheet on the second sheet when the second sheet is stacked on both of the first stacking unit and the second stacking unit.

24. The apparatus according to claim 21, further comprising:

a notifying unit configured to allow the stacking control unit to notify a user to remove a stacked sheet when stacking the second sheet on the first sheet is restricted.

25. The apparatus according to claim 21, wherein the second sheet is a sheet to be ejected by execution of a job, and wherein the apparatus further comprises a job control unit configured to allow the stacking control unit to execute, among jobs subsequent to the job for ejecting the second sheet, a job for ejecting the first sheet in advance of executing the job for ejecting the second sheet when stacking of the second sheet ejected by execution of the job on the first sheet is restricted.

* * * * *